US010177493B2

(12) United States Patent
Yildiz et al.

(10) Patent No.: US 10,177,493 B2
(45) Date of Patent: Jan. 8, 2019

(54) CONNECTOR ASSEMBLY WITH INTEGRATED LEVER LOCKING SYSTEM

(71) Applicant: Aptiv Technologies Limited, St. Michael (BB)

(72) Inventors: Zuelkuef Yildiz, Unna (DE); Necdet Papurcu, Datteln (DE); Klaus Storandt, Witten (DE); Andreas Weidemeyer, Neukirchen (DE)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/792,949

(22) Filed: Oct. 25, 2017

(65) Prior Publication Data

US 2018/0131132 A1 May 10, 2018

(30) Foreign Application Priority Data

Nov. 9, 2016 (EP) ..... 16198000

(51) Int. Cl.
*H01R 13/629* (2006.01)
*H01R 13/64* (2006.01)
(Continued)

(52) U.S. Cl.
CPC . *H01R 13/62938* (2013.01); *H01R 13/62927* (2013.01); *H01R 13/62955* (2013.01);
(Continued)

(58) Field of Classification Search
CPC ..... H01R 13/62938; H01R 13/62927
(Continued)

(56) References Cited

U.S. PATENT DOCUMENTS 5,401,179 A * 3/1995 Shinchi ..... H01R 13/62933 439/157
5,873,745 A * 2/1999 Duclos ..... H01R 13/62944 439/157

(Continued)

FOREIGN PATENT DOCUMENTS

| | | | |
|---|---|---|---|
| JP | 2003223955 | A | 8/2008 |
| WO | 2007098253 | A2 | 8/2007 |
| WO | 2015055787 | A1 | 4/2015 |

*Primary Examiner* — Tulsidas C Patel
*Assistant Examiner* — Peter G Leigh
(74) *Attorney, Agent, or Firm* — Robert J. Myers

(57) ABSTRACT

An electrical connector assembly includes a connector housing, a cap, and a lever pivotably attached to the cap. The lever moves from a transport position, a preliminary mating position, and a fully mated position. The connector assembly has a first holding means holding the lever in the transport position and a second holding means holding the lever in the preliminary mating position. The first holding means has a locking arm on the lever and a latching projection on the cap. The connector housing has a wall extending towards the cap configured to release the locking arm from the latching projection and move the lever towards the preliminary mating position. The second holding means comprises a locking protrusion and a locking reception receiving the locking protrusion when the lever is in the preliminary mating position. A mating connector displaces the locking protrusion to release the lever when the assembly is mated.

15 Claims, 8 Drawing Sheets

(51) Int. Cl.
*H01R 27/02* (2006.01)
*H01R 13/506* (2006.01)

(52) U.S. Cl.
CPC ..... *H01R 13/64* (2013.01); *H01R 13/506* (2013.01); *H01R 27/02* (2013.01)

(58) Field of Classification Search
USPC ..... 439/157
See application file for complete search history.

(56) References Cited

U.S. PATENT DOCUMENTS 5,938,458 A * 8/1999 Krehbiel ..... H01R 13/62938 439/157
6,120,308 A * 9/2000 Hayashi ..... H01R 13/62972 439/157
6,217,354 B1 * 4/2001 Fencl ..... H01R 13/62977 439/157
6,447,312 B1 * 9/2002 Takata ..... H01R 13/62938 439/157
6,705,882 B2 * 3/2004 Casses ..... H01R 13/62933 439/153
6,997,725 B2 * 2/2006 Stella ..... H01R 13/453 439/157
7,238,050 B2 * 7/2007 Sakakura ..... H01R 9/032 439/157
7,241,156 B1 * 7/2007 Margrave ..... H01R 13/62938 439/157
7,261,575 B2 * 8/2007 Buchter ..... H01R 13/62944 439/157
7,361,036 B2 * 4/2008 Pittenger ..... H01R 13/62955 439/157
7,431,598 B2 * 10/2008 Ikeya ..... H01R 13/62938 439/160
7,559,778 B2 * 7/2009 Pittenger ..... H01R 13/62955 439/157
7,695,297 B2 * 4/2010 Pittenger ..... H01R 13/62955 439/157
8,297,992 B2 * 10/2012 Park ..... H01R 13/6295 439/157
8,480,417 B2 * 7/2013 Suemitsu ..... H01R 13/46 439/157
9,093,786 B2 * 7/2015 Forell ..... H01R 13/62938
9,178,307 B2 * 11/2015 Papurcu ..... H01R 13/533
9,203,186 B2 * 12/2015 Shishikura ..... H01R 13/62977
9,407,037 B2 * 8/2016 Kim ..... H01R 13/62938
2001/0044228 A1 11/2001 Yutaka et al.
2002/0022391 A1 * 2/2002 Beck, Jr. ..... H01R 13/62938 439/157
2002/0182908 A1 * 12/2002 Maegawa ..... H01R 13/62938 439/157
2003/0022539 A1 * 1/2003 Takahashi ..... H01R 13/62938 439/157
2004/0192090 A1 * 9/2004 Flowers ..... H01R 13/5812 439/157
2006/0040536 A1 * 2/2006 Putnam ..... H01R 13/62977 439/157
2006/0089031 A1 * 4/2006 Flowers ..... H01R 13/5812 439/157
2009/0203240 A1 * 8/2009 Matsumura ..... H01R 13/62938 439/153
2011/0014805 A1 * 1/2011 Sakamaki ..... H01R 13/62955 439/153
2014/0273566 A1 9/2014 Allgood et al.
2016/0099520 A1 * 4/2016 Papurcu ..... H01R 13/641 439/752
2016/0254618 A1 * 9/2016 Ludwig ..... H01R 13/62938 439/372

* cited by examiner

CONNECTOR ASSEMBLY WITH INTEGRATED LEVER LOCKING SYSTEM

CROSS-REFERENCE TO RELATED APPLICATION

This application claims the benefit under 35 U.S.C. § 119(a) of Patent Application No. 16198000.8 filed in the European Patent Office on Nov. 9, 2016, the entire disclosure of which is hereby incorporated by reference.

TECHNICAL FIELD OF THE INVENTION

The present invention relates to an electrical connector assembly comprising a mate assist lever, which can be locked in a transport position, a preliminary mating position and a fully mated position.

BACKGROUND OF THE INVENTION

In many fields of applications, in particular in the case of mass production assembly processes, it is important that electrical connectors can be connected easily and fast. In cases where connectors have a plurality of electrical contact terminals to be mated, as it is often the case in the field of automotive applications, it is common that the connectors are provided with mate assist mechanisms in the form of mate assist levers or sliders to facilitate mating of the connector and a counter connector (i.e. a mating connector).

Such mate assist mechanisms usually are provided linearly movable or pivotably movable on a connector housing. Upon mating of the connector with a corresponding mating connector, the mate assist mechanisms are moved from a first, preliminary mating position, to a second, fully mated position, thereby facilitating the mating process.

A typical example of a lever mated connector assembly is for example described in International Patent Application Publication No. WO 2007/098253. In this document, an electrical connector assembly comprising a mate assist lever, which serves to facilitate the mating of the connector assembly, is described. The mate assist lever is pivotably mounted to a first connector and can be moved from a preliminary mating position to a fully mated position. During this movement, a cam element provided on the pivotably lever engages a corresponding cam mechanism of the mating connector, whereby the two connectors are pulled towards each other upon movement of the lever. When moved into the final mated position, a portion of the lever snaps behind a latch member on the connector housing to lock the mate assist lever in the position, thereby also locking the mating of the two connectors.

A typical example of a connector assembly with a mate assist lever is further described in US Patent Application Publication No. US 2006/0089031. Similarly as in the case of the prior document discussed above, the mate assist lever disclosed in this document is provided pivotably on a connector housing and has generally a U-shaped form with two lever arms connected by common web. Each lever arm has a pivot axis that passes through the lever arm. The lever arms are provided such, that, from the preliminary mating position, they can only be rotated into the fully mated position, but not in the opposite direction. However, with this prior art construction it is possible that the lever moves unintentionally or intentionally from the preliminary mating position to another position in the direction to the fully mated position, when no mating connector is present. In such a position different from the preliminary mating position, it is not possible to mate the two connectors, so that an operator has to manually displace the lever back into the preliminary mating position to start the mating process. This requires an additional working step what is not desirable.

International Patent Application Publication No. WO 2015/055787 discloses a connector system that solves the above-mentioned problem. In n global manufacturing required parts and modules are produced and distributed over the globe and the parts are delivered in sub modules. In this cases it is important to fix all movable attachments during the transport to prevent damages. On the other hand when arrived in the plant the parts have to be ready for immediately assembling. In the production plants preparatory steps while assembling are not accepted.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is therefore an object of the present invention to provide an electrical connector assembly with a mate assist lever of robust and simple construction, whereby it is secured that the lever is secure during transport and the sub modules do fit to the counterparts. Furthermore the lever is always locked in a correct position until a counterpart releases the lock while mating. It is further an object of the present invention, to achieve these advantages with an inexpensive product, which can preferably be produced by injection molding.

According to the invention, an electrical connector assembly comprising a connector housing, a cap and a mate assist mechanism, comprising a lever pivotably arranged on the cap. The lever is movable from a transport position to a preliminary mating position and further to a fully mated position. Wherein the connector assembly comprises a first holding means to releasably hold the lever in the transport position and a second holding means to releasably hold the lever in the preliminary mating position. The first holding means comprises a locking arm arranged on the lever and a corresponding latching projection arranged on the cap, latching the locking arm when the lever is in the transport position. The connector housing has a wall extending opposite the mating direction towards the cap and configured to release the locking arm from the latching projection and move the lever towards the preliminary mating position. The second holding means comprises a locking protrusion and a corresponding locking reception that receives the locking protrusion when the lever is in the preliminary mating position. The locking protrusion is arranged on the connector housing. The locking reception is arranged on the lever. Wherein, upon mating with a corresponding mating connector, the mating connector displaces the locking protrusion to release the lever.

Preferably, the lever has a pivot axis that is substantially perpendicular to the mating direction and wherein the free end of the locking arm is flexible along the pivot axes. The flexibility of the arm allows unlocking the lever from the cap.

Preferably, the locking arm has a sloped surface starting from the free end of the locking arm, sloped towards the cap.

The sloped surface bends, in corporation with the wall, the free ends of the arms always from the cap while assembling the cap to the connector housing. When the arms are bent far away the lever is released and can move to the next position.

Preferably, the locking arm comprises an arm locking surface and the latching projection comprises a projection locking surface whereby the surfaces are in the same plane and contact each other only in the transport position. The surfaces protrude against each other and are pressed to each other when forces pull on the lever. This design promises a strong locking performance.

Preferably, the position of the lever in the transport position differs from the position of the lever in the preliminary mating position by a rotation movement of an angle of 5 to 15 degrees around the pivoting axes. Because the positions are that close to each other, sloped edges on the free ends of arms and protrusions and on the locking reception help to guide the lever from one position to the next. This provides a fluent movement from one position to the next.

Preferably, the wall extends parallel to the mating axis and comprises a sloped wall edge extending in an angle away from the mating axis wherein the sloped wall edge is arranged below the latching projection in mating direction. The sloped wall edge comes continuous closer towards the latching projection. This allows defining precisely the position when the locking arms are released.

Preferably, the wall extends parallel to the mating axis and comprises a curved wall edge extending in a curve away from the mating axis and wherein the curved wall edge is arranged below the latching projection in mating direction. A curved wall edge is beside the sloped wall edge an alternative opportunity to define a working release position.

Preferably, the wall extends abutting a cap wall of the cap, wherein when the cap is moved to the connector housing while mating, the wall protrudes between the cap wall and the arm sloped surface and bends the free end of the locking arm away from the cap wall, whereby the locking arm is released.

Preferably, the wall moves the locking arm so that the lever rotates around the pivot axis towards the preliminary mating position. After releasing the lever the wall moves the free end of the locking arms a little further so that the sloped areas guide the lever into the next position.

Preferably, the lever has a cam groove comprising an open end, wherein limiting protrusions narrow the open end to a narrowed wide. The open end guides the cam follower into the groove. The limiting protrusions form a barrier so that the cam follower needs some force to overcome the barrier. While connecting the mating connector this has the effect that, after passing the limiting protrusions, the operator hits the cam follower against the lever, because he had to press with increased force and can't stop immediately.

Preferably, the cam groove has a curved tilt surface for cooperating with a cam follower of the mating connector. The operator hits the curved tilt surface and passes through the impulse so that the lever gets a hit against the curved tilt surface that leads to a movement of the lever. The lever can move because the cam follower already released the lever from the second holding means.

Preferably, the narrowed wide is equal or smaller as a diameter of the cam follower. To prevent the cam follower trying to enter the grooves, the entry is a little bit smaller than the diameter that would be necessary for an easy parsing the cam follower into the groove. The narrowed entry needs some force to pass. A further advantage of this design is that when the cam follower is in the groove the same force is necessary to get it out of the groove. This is an advantage when the connector has to be assembled upside down and when it slips out of the operator's hand it will be still attached to the mating connector.

Preferably, the tilt surface is curved in that way that, when the lever is in the pre mating position and a cam follower hits the tilt surface while mating, the lever is moved in the direction towards the fully mated position. Dependent on the geometry of the lever and the distribution of the mass of the lever the tilt surface has to be designed to get the best results. A well designed tilt surface should guide to a connector whereby the lever moves nearly by itself from the preliminary mating position to the fully mated position and the operator only needs to do a small final movement.

Preferably, the tilt surface is in mating direction parallel spaced to the pivot axis and comprises an angle to the mating axis.

Preferably, the connector assembly comprises a corresponding mating connector.

Further features and advantages will appear more clearly on a reading of the following detailed description of the preferred embodiment, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
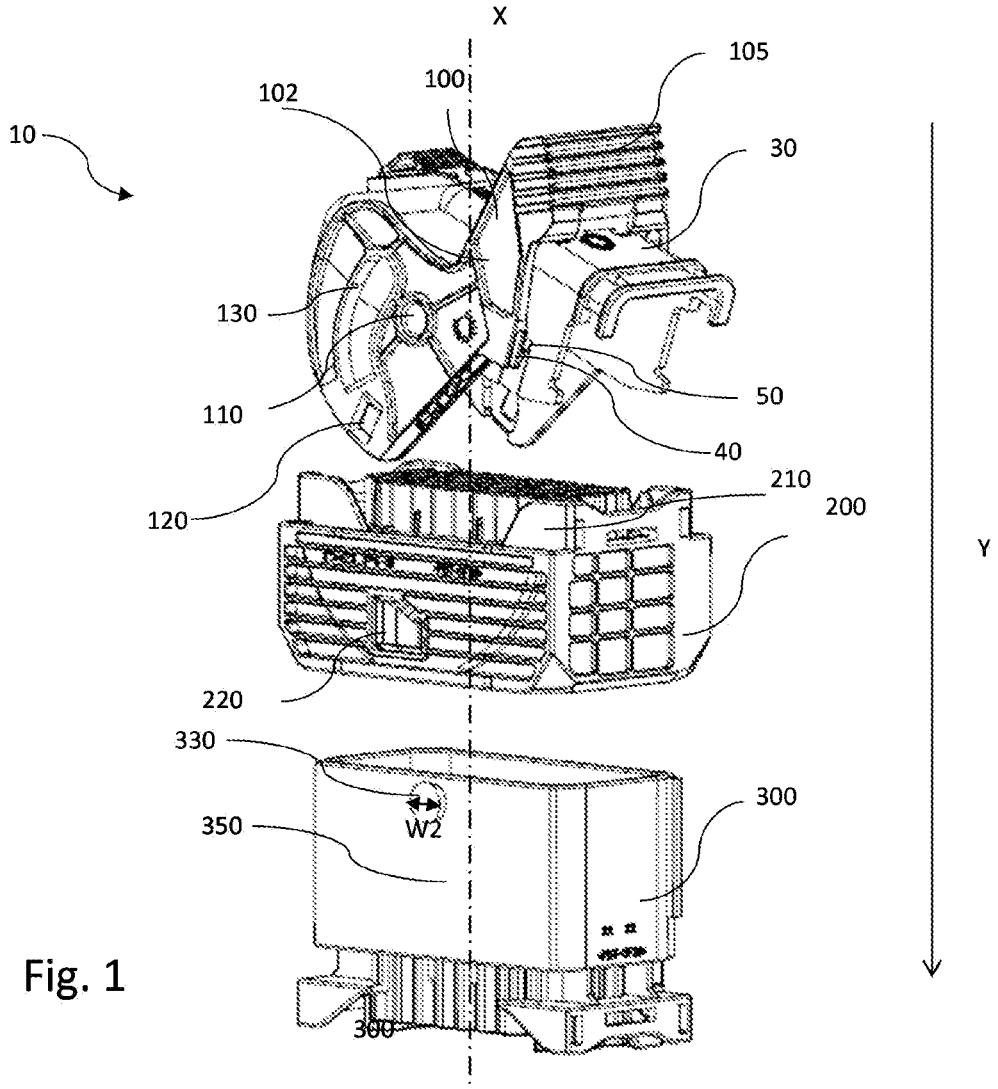
FIG. 1 shows a connector assembly in a three dimensional schematic view in preassembled condition according to an embodiment of the invention.

FIG. 1 shows a non-limiting example of a connector assembly 10 in a three dimensional schematic view inside. The connector assembly 10 comprises a lever 100, a connector housing 200 and a cap 30 which forms a part of the connector housing 200. The lever 100 is pivotably arranged on the cap 30 and is configured to be pivotably around a pivot axis 110. The lever 100 has a general U-shape configuration with two parallel lever arms 102, 103 connected by a common web 105, which extends perpendicular to the lever arms 102, 103. In the shown embodiment each lever arm 102, 103 is symmetrical to the other and has a pivot axis 110 that passes through the lever arm. The lever 100 serves to facilitate a mating process between the connector housing 200 and a corresponding mating connector 300. The working principle of such mate assist mechanisms is generally well known to the skilled person, as from e.g. the prior art discussed above, so that it is refrained herein from giving a more detailed explanation thereof.

Figure 2B:
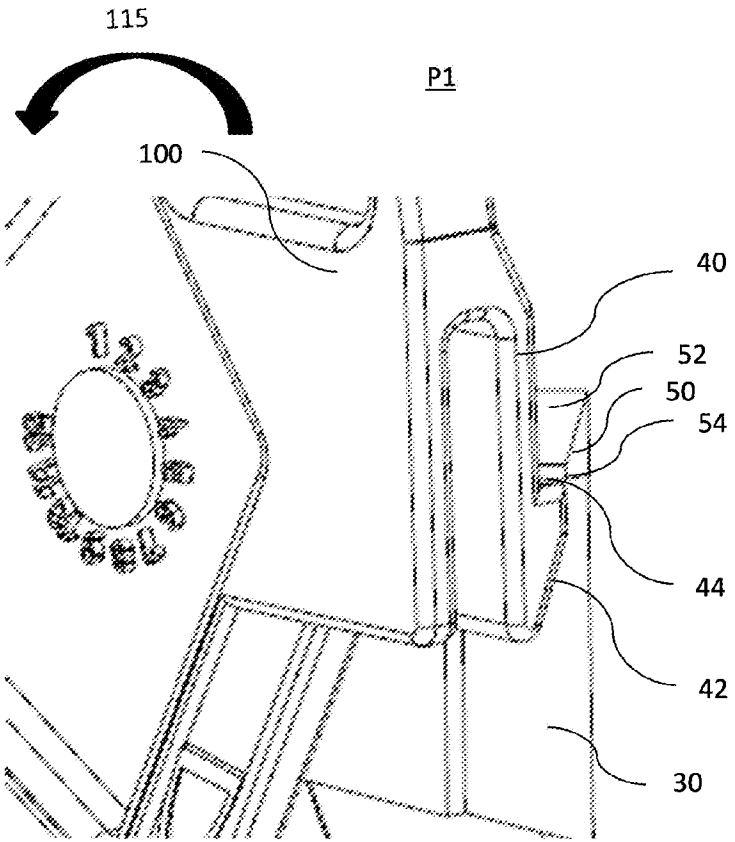
FIGS. 2*a* and 2*b* show the cap and lever of the connector assembly of FIG. 1 in a detailed view according to an embodiment of the invention.
Figure 2A:
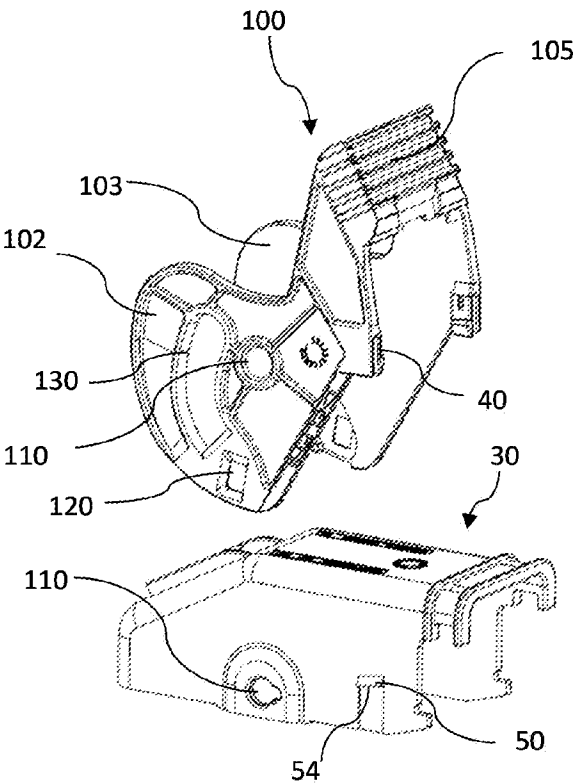
Figure 4B:
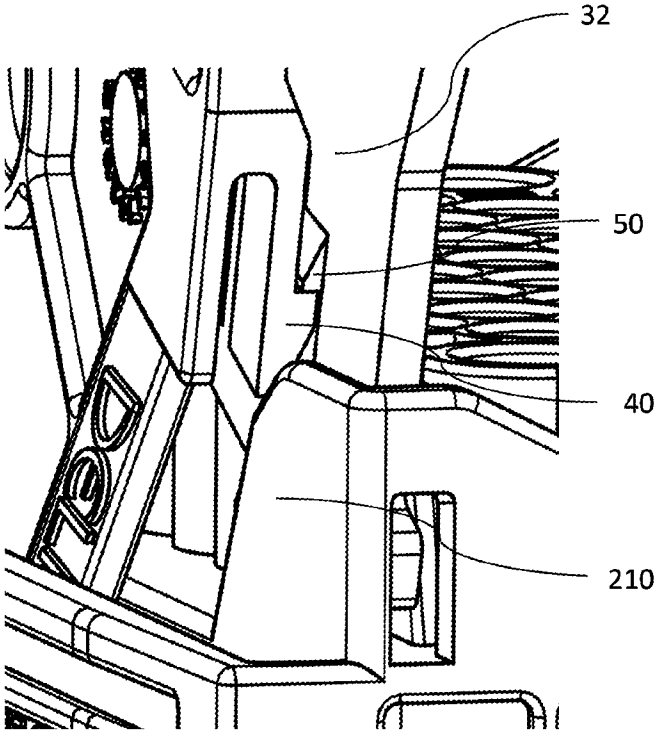
FIGS. 4*a* and 4*b* show details of the first latching means according to an embodiment of the invention.
Figure 4A:
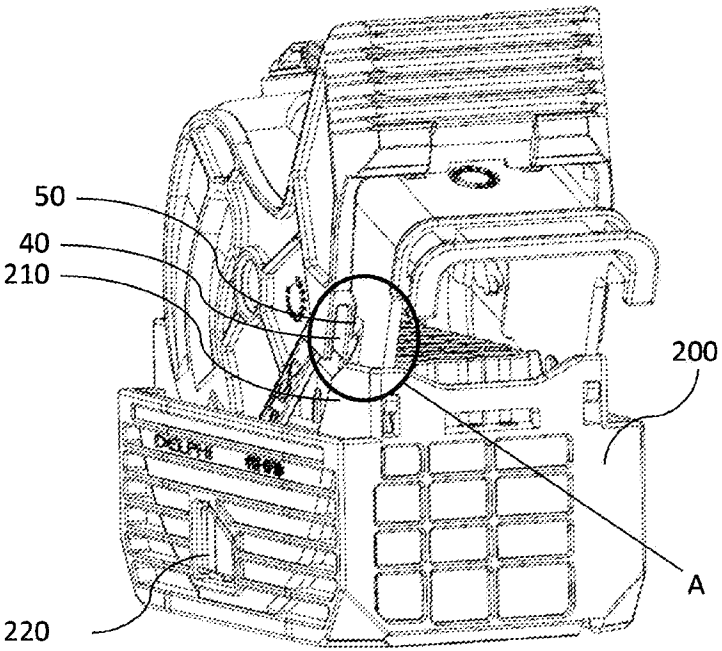

FIG. 2*a* shows the lever 100 and the cap 30 as separate parts before assembled together. The lever has a flexible locking arm 40 and the cap has a latching projection 50 arranged on the cap 30. After assembling the lever 100 is in the transport position P1, it is rotatably connected to the cap 30 at the pivot axis 110 and is locked by the flexible locking arm 40 and the latching projection 50 as shown in FIG. 2*b* and FIG. 4*b*. The lever 100 is locked because a surface 44 of the flexible locking arm 40 is in contact with a surface 54 of the latching projection 50. The surfaces 44, 54 are in the same plane when the lever 100 is locked in the transport position P1. The surfaces 44, 54 contact each other only in the transport position. A free end of the flexible locking arm 40 is flexible along the pivot axis 110. The flexible locking arm 40 has a sloped surface 42 starting from the free end of the flexible locking arm 40, sloped towards the cap 30. The latching projection 50 has a sloped surface 52 starting from the free end of the latching projection 50 sloped towards the cap 30. The connector housing 200 comprises a wall 210 extending opposite the mating direction Y towards the cap 30 and is configured to release the flexible locking arm 40 from the latching projection 50 as shown in FIGS. 4*a* and 4*b*. Furthermore the wall 210 moves the lever 100 towards the preliminary mating position P2 (not shown). The wall 210 extends parallel to the mating axis X and comprises a sloped wall edge 212 extending in an angle away from the mating axis X. The sloped wall edge 212 is arranged below the latching projection 50 in mating direction Y. The wall 210 comprises also a curved wall edge 214 extending in a curve away from the mating axis X. The curved wall edge 214 is arranged below the latching projection in mating direction Y.

FIG. 4*b* shows the area A from FIG. 4*a* in more detail. The wall 210, while mating, extends abutting a cap wall 32 of the cap 30, when the cap 30 is moved to the connector housing 200. The wall 210 protrudes between the cap wall 32 and the sloped surface 42 of the flexible locking arm 40 and bends the free end of the flexible locking arm 40 away from the cap wall 32, thereby release the flexible locking arm 40. The position of the lever 100 in the transport position P1 differs from the position of the lever 100 in the preliminary mating position P2 by a rotation movement through an angle of 5 to 15 degrees about the pivot axis 110.

Figure 5B:
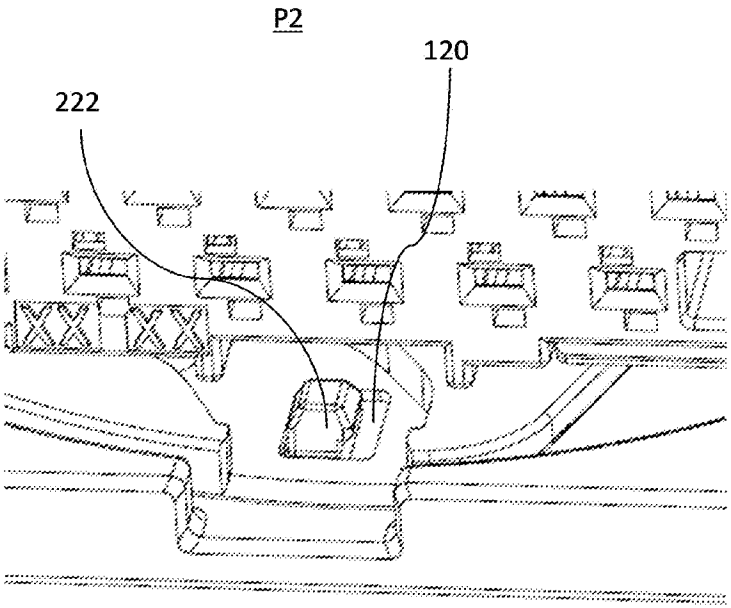
FIGS. 5*a* and 5*b* show details of the second latching means according to an embodiment of the invention.
Figure 5A:
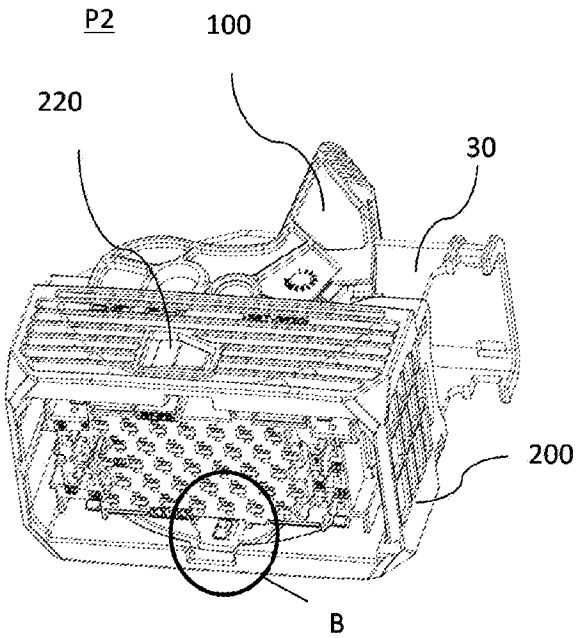
Figure 6A:
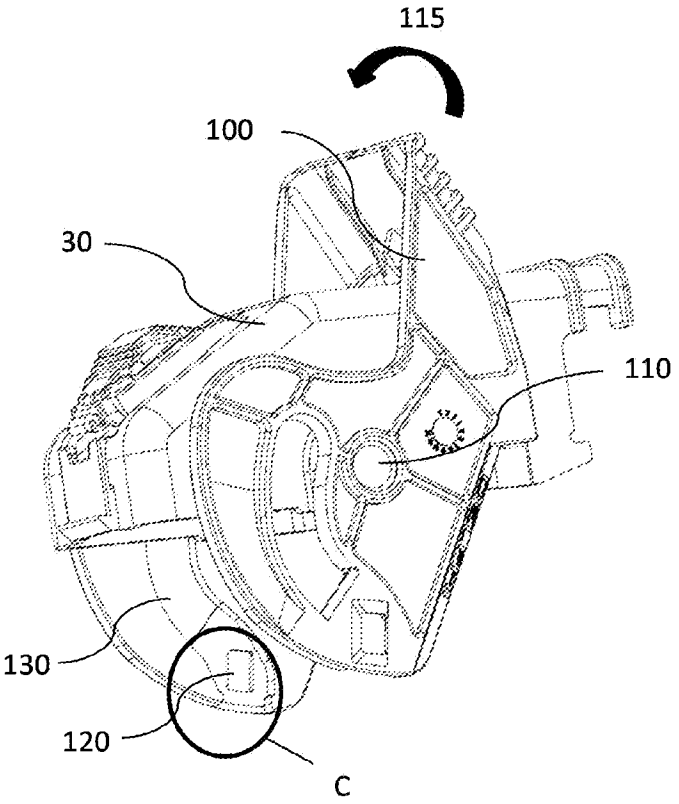
FIGS. 6*a* and 6*b* show details of the cam groove in the lever according to an embodiment of the invention.
Figure 6B:
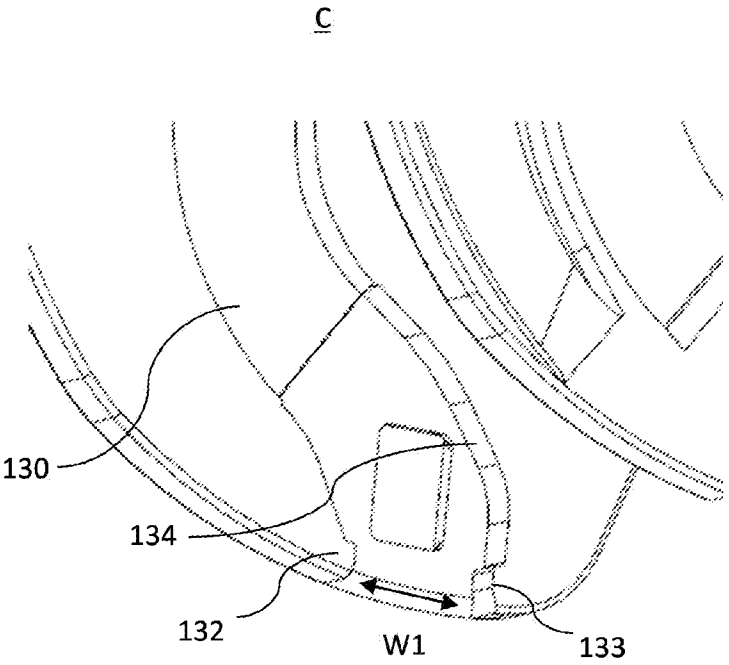

The connector housing 200 comprises a latch wing 220 (see FIG. 3*a*) that comprises a locking protrusion 222 (see FIG. 5*b*). In the position shown in FIGS. 1 and 2*b*, the lever is in the transport position P1. The lever 100 further comprises two cam grooves 130 that are respectively arranged in each of the lever arms 102, 103. The entrance to the cam grooves 130 is aligned such that a cam follower of a mating connector can enter the grooves (see FIG. 7).

Figure 3B:
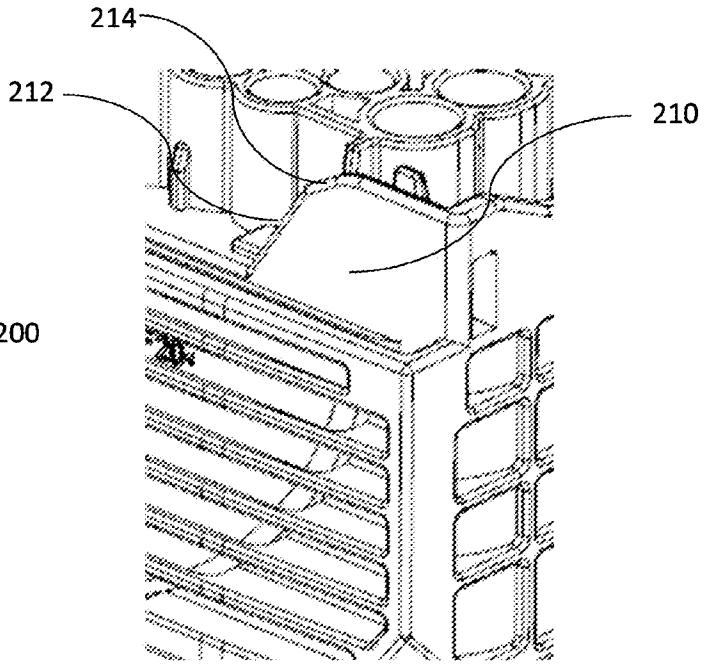
FIGS. 3*a* and 3*b* show details of the connector body according to an embodiment of the invention.
Figure 3A:
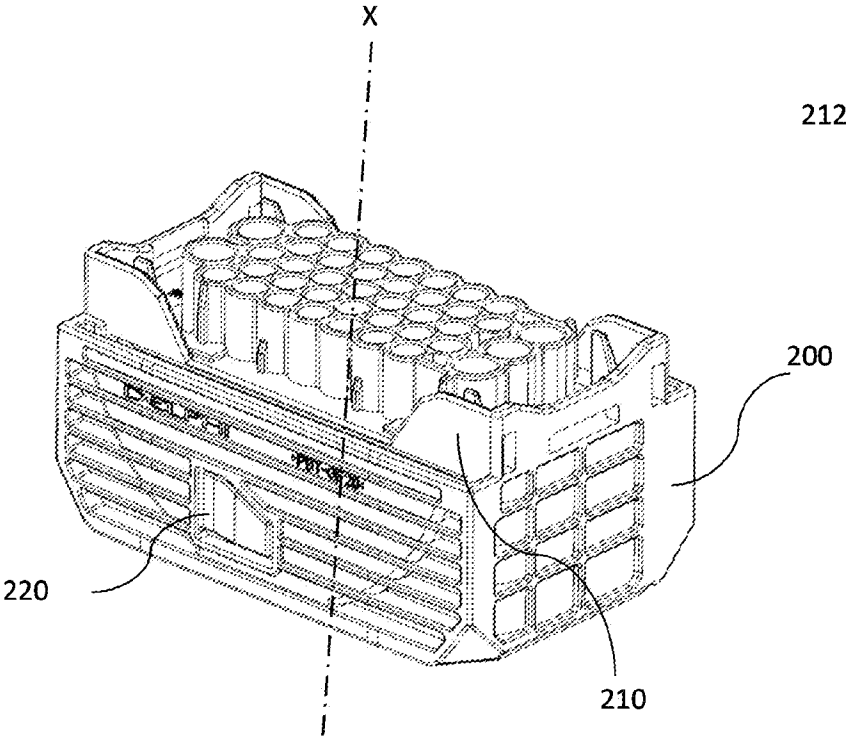

FIG. 3*a*, 3*b* show that the connector housing 200 further comprises a locking protrusion 222 that is arranged on the latch wing 220. However, it is to be noted that the locking protrusion 222 can also be arranged on another part of the connector housing 200. The lever 100 comprises a locking reception 120 that receives the locking protrusion 222 when the lever is in the preliminary mating position P2. The locking protrusions 222 extend into the respective entrances to the cam grooves 130 of the lever arms 102, 103.

Figure 7:
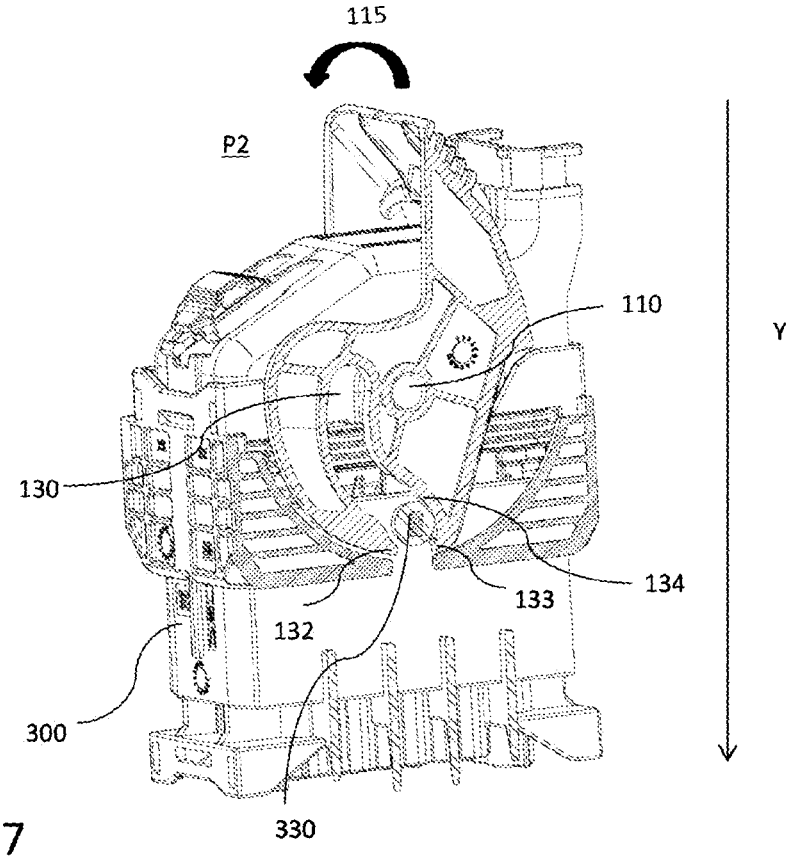
FIG. 7 shows a connector assembly in the preliminary mating position according to an embodiment of the invention.

FIG. 5*b* shows a cut-away side view of the inventive connector assembly. In the embodiment shown, the lever 100 is in the preliminary mating position P2. When released, upon the connector housing 200 being mated with a corresponding mating connector 300, the lever 100 that is in the preliminary mating position P2 is movable upon application of a force as indicated in FIG. 7, in the rotational direction 115 around the pivot axis 110. However, due to the fact that the connector housing 200 is not mated with a corresponding mating connector 300 in the embodiment shown, as indicated by the circular arrow in FIG. 5*b*, the lever 100 cannot be moved around the pivot axis 110, because the locking protrusions 222 and the corresponding locking receptions 120 hold the lever in the preliminary mating position. Thereby, it is neither intentionally nor unintentionally possible to move the lever into the fully mated position or to another position than the preliminary mating position when no corresponding mating connector 300 is present.

FIG. 7 shows a view of the connector assembly in mating position in accordance with the invention. A layer of the lever arm 102 remains in the figure to better display how the mechanics work. The mating connector 300 comprises a mating connector housing 310 and two cam followers 330 in form of cam bolts being arranged and protruding from two opposite mating walls 350 (outer walls) of mating connector 300. When mated, as shown in FIG. 7, the cam followers 330 of the corresponding mating connector 300 displace the locking protrusions 222 of the connector housing 200, thereby releasing the lever 100. Although not clearly visible in FIG. 7, the skilled person will recognize that thereby the locking protrusions will be moved or deflected outwardly out of engagement with the locking reception 120. In the mating process the surface of the locking protrusion 222 interacts with the cam followers 330, thereby facilitating the displacement of the locking protrusion 222 by the corresponding mating connector 300. The skilled person will recognize that the corresponding cam follower 330 displaces the locking protrusion 222. Upon mating of the corresponding mating connector 300 with the connector housing 200 and the displacement of the locking protrusions 222, the lever 100 is now free to be pivoted around the pivot axis 110 perpendicular to the mating direction. The cam followers 330 of the mating connector 300 are configured to interact with the cam grooves 130 of the lever 100 as shown in FIG. 7. The cam grooves 130 comprising an open end 131. Limiting protrusions 132, 133 narrow the open end to a narrowed wide W1. The narrowed wide W1 is equal or smaller as a diameter W2 of the cam follower 330. Furthermore, the cam grooves 130 have a curved tilt surface 134 for cooperating with a cam follower 330 of the mating connector 300. The tilt surface 134 is curved in that way that when the lever 100 is in the pre mating position P2 and a cam follower 330 hits the tilt surface 134 while mating, the lever 100 is moved in the direction towards the fully mated position P3 as shown in FIG. 7. The tilt surface 134 is in mating direction Y parallel spaced to the pivot axis 110 and comprises an angle to the mating axis X.

Figure 8:
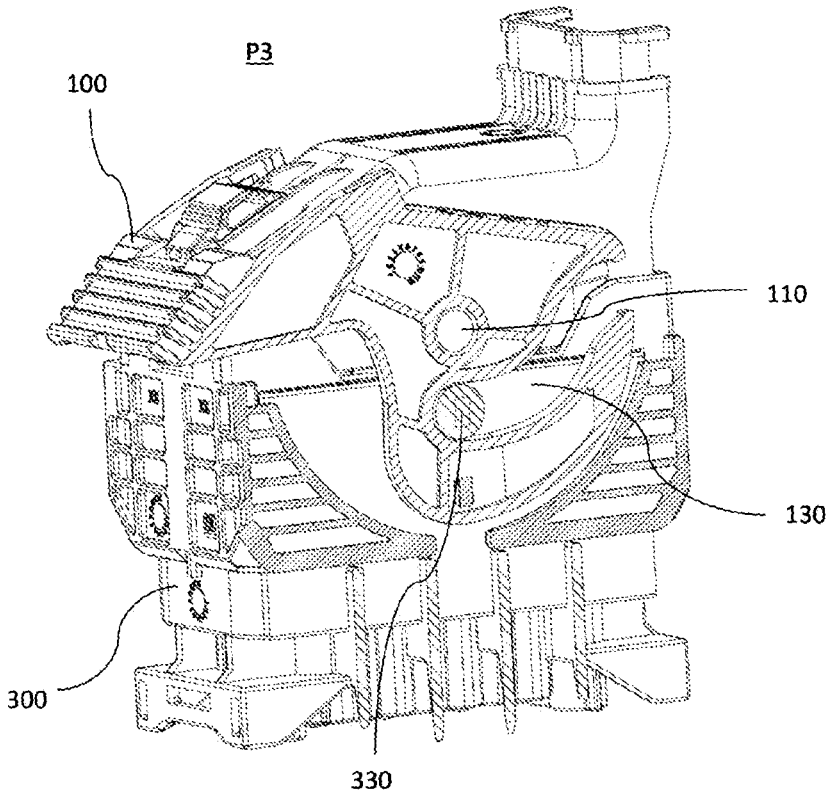
FIG. 8 shows a connector assembly in the fully mated position according to an embodiment of the invention.

FIG. 8 shows a view of the connector assembly 10 in mating position. Similarly to FIG. 7, a layer of the lever arm 102 also remains in the figure to better display how the mechanics work. The mating connector further comprises mating connector pins (not shown) that are configured to interact with corresponding pin receptions (not shown) arranged on the mating face for establishing an electrical connection when the connectors are in mated position. The cam followers 330 of the corresponding mating connector 300 displace the locking protrusion 222 of the connector housing 200 to such an extent, that thereby the lever 100 is released. In the position shown in FIG. 7, it is now possible to move the lever 100 from the preliminary mating position to the fully mated position. As the skilled person recognizes, upon turning the lever 100 anticlockwise (as seen in FIG. 7) from the preliminary mating position P2 to the fully mated position P3, the cam means 130, 330 provided on the lever 100 and the mating connector 300 interact so that the connector housing 200 and the mating connector 300 are pulled towards each other to achieve a full mating of the connectors.

By the concept of displacing the locking protrusion 222 by the cam followers 330 of the mating connector 300 it is assured that the lever 100 can only be released when the connector housing 200 is in the correct initial mating position with the corresponding mating connector 300; in other words when the cam followers 330 are arranged in the entrances of the cam grooves. Thereby, the rotation or movement of the lever 100 is only allowed, when the rotation or movement of the lever 100 is necessary, i.e. in the mating process. It is advantageously prevented that, e.g. during transport or shipment of the connector assembly 10, the lever 100 is displaced unintentionally or intentionally when no corresponding mating connector 300 is present and it is prevented that an additional working step has to be provided to bring the lever back into the preliminary mating position P2 as it is necessary with the prior art connector assemblies.

The skilled person will recognize that the connector assembly 10 can be used and is used in practice in any spatial orientation, so that the expressions clockwise, up, down, left or right as used herein are only used to facilitate the description of the different elements of the connector assembly 10 shown in the figures.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. An electrical connector assembly: comprising:
a connector housing;
a cap;
a mate assist mechanism;
a lever pivotably arranged on the cap, wherein the lever is movable from a transport position to a preliminary mating position and further movable to a fully mated position;
a first holding means configured to releasably hold the lever in the transport position; and
a second holding means configured to releasably hold the lever in the preliminary mating position, wherein the first holding means comprises a locking arm arranged on the lever and a corresponding latching projection arranged on the cap, thereby latching the locking arm when the lever is in the transport position, wherein the connector housing has a wall extending opposite a mating direction towards the cap and is configured to release the locking arm from the latching projection and move the lever towards the preliminary mating position, wherein the second holding means comprises a locking protrusion and a corresponding locking reception receiving the locking protrusion when the lever is in the preliminary mating position, wherein the locking protrusion is arranged on the connector housing, wherein the locking reception is arranged on the lever, and wherein the mating connector displaces the locking protrusion to release the lever upon mating with a corresponding mating connector.

2. The electrical connector assembly according to claim 1, wherein the lever has a pivot axis that is substantially perpendicular to the mating direction and wherein a free end of the locking arm is flexible along the pivot axis.

3. The electrical connector assembly according to claim 2, wherein the locking arm has a sloped surface starting from the free end of the locking arm, sloped towards the cap.

4. The electrical connector assembly according to claim 3, wherein the wall extends abutting a cap wall of the cap, wherein when the cap is moved to the connector housing while mating, the wall protrudes between the cap wall and the sloped surface of the locking arm and bends a free end of the locking arm away from the cap wall, whereby the locking arm is released.

5. The electrical connector assembly according to claim 2, wherein the position of the lever in the transport position differs from the position of the lever in the preliminary mating position by a rotation movement of an angle of 5 to 15 degrees around the pivot axis.

6. The electrical connector assembly according to claim 1, wherein the locking arm comprises an arm locking surface and the latching projection comprises a projection locking surface whereby the arm locking surface and the projection locking surface are in the same plane and contact each other only in the transport position.

7. The electrical connector assembly according to claim 1, wherein the wall extends parallel to the mating axis and comprises a sloped wall edge extending in an angle away from the mating axis wherein the sloped wall edge is arranged below the latching projection in the mating direction.

8. The electrical connector assembly according to claim 1, wherein the wall extends parallel to the mating axis and comprises a curved wall edge extending in an curve away from the mating axis and wherein the curved wall edge is arranged below the latching projection in the mating direction.

9. The electrical connector assembly according to claim 1, wherein the wall moves the locking arm so that the lever rotates around a pivot axis towards the preliminary mating position.

10. The electrical connector assembly according to claim 9, wherein the lever has a cam groove comprising an open end, wherein limiting protrusions narrow the open end to a narrowed wide.

11. The electrical connector assembly according to claim 10, wherein the cam groove has a curved tilt surface for cooperating with a cam follower of the corresponding mating connector.

12. The electrical connector assembly according to claim 11, wherein the narrowed wide is equal or smaller as a diameter of the cam follower.

13. The electrical connector assembly according to claim 11, wherein a tilt surface is curved in that way that when the lever is in a pre-mating position and a cam follower hits the tilt surface while mating, the lever is moved in a direction towards the fully mated position.

14. The electrical connector assembly according to claim 13, wherein the tilt surface is in the mating direction parallel spaced to the pivot axis and comprises an angle to the mating axis.

15. The electrical connector assembly according to claim 1, further comprising the corresponding mating connector.

* * * * *